United States Patent [19]

Nakasa et al.

[11] Patent Number: 4,829,316

[45] Date of Patent: May 9, 1989

[54] SMALL SIZE ANTENNA FOR BROAD-BAND ULTRA HIGH FREQUENCY

[75] Inventors: Kazuhiko Nakasa, Tokyo; Yoshiimi Egashira, Kanagawa, both of Japan

[73] Assignee: Harada Kogyo Kabushiki Kaisha, Tokyo, Japan

[21] Appl. No.: 193,130

[22] Filed: May 4, 1988

Related U.S. Application Data

[63] Continuation of Ser. No. 774,759, Sep. 11, 1985, abandoned.

[30] Foreign Application Priority Data

Jan. 31, 1985 [JP] Japan ..... 60-15518

[51] Int. Cl.[4] ..... H01Q 9/16

[52] U.S. Cl. ..... 343/792; 343/791; 343/864

[58] Field of Search ..... 343/792, 790, 791, 863, 343/864, 860

[56] References Cited

U.S. PATENT DOCUMENTS

| | | | |
|---|---|---|---|
| 2,239,724 | 4/1941 | Lindenblad | 343/791 X |
| 2,492,404 | 12/1949 | Streib et al. | 343/791 X |
| 3,576,578 | 4/1971 | Harper | 343/791 |
| 3,656,167 | 4/1972 | Lea | 343/860 X |
| 4,180,819 | 12/1979 | Nakano | 343/792 |
| 4,496,953 | 1/1985 | Spinks, Jr. et al. | 343/792 |
| 4,504,834 | 3/1985 | Garay et al. | 343/792 X |
| 4,509,056 | 4/1985 | Ploussions | 343/791 |
| 4,583,589 | 4/1986 | Kasevich | 343/719 X |
| 4,658,260 | 4/1987 | Myer | 343/792 |
| 4,673,949 | 6/1987 | Sheriff | 343/864 X |
| 4,730,195 | 3/1988 | Philips et al. | 343/792 X |

FOREIGN PATENT DOCUMENTS

| | | | |
|---|---|---|---|
| 0643577 | 6/1946 | United Kingdom | 343/790 |
| 1527800 | 11/1978 | United Kingdom | 343/790 |

*Primary Examiner*—Eugene R. LaRoche
*Assistant Examiner*—Seung Ham
*Attorney, Agent, or Firm*—Koda and Androlia

[57] ABSTRACT

A small size broad-band ultra high frequency antenna including a dielectric substance in the sleeve of an antenna body whereby approximating resonance frequency of the sleeve portion to resonance frequency of the body of the antenna so that a double-tuning circuit is formed thereby causing the impedance characteristics of the antenna to have double-peak characteristics within the working frequency band. The antenna further includes an impedance matching transformer for matching the impedance of the antenna to the characteristic impedance of a feeder line connected to the antenna, the matching transformer being composed of a coaxial type impedance transducer which has an opposite reactance component sufficient to offset the reactance component of the antenna and has the characteristic impedance convertible to the feeder line impedance.

2 Claims, 2 Drawing Sheets

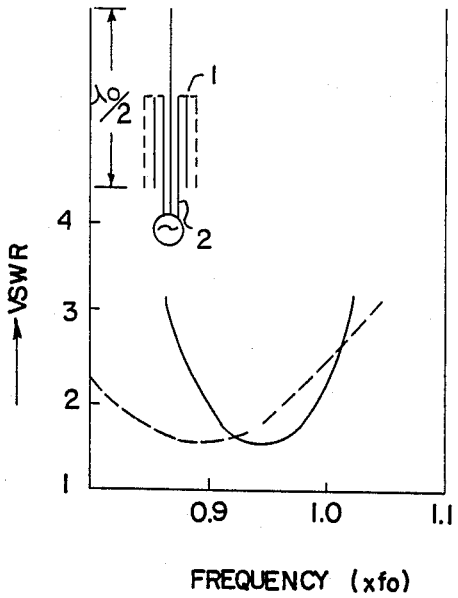
FIG. 1
PRIOR ART
FIG. 2
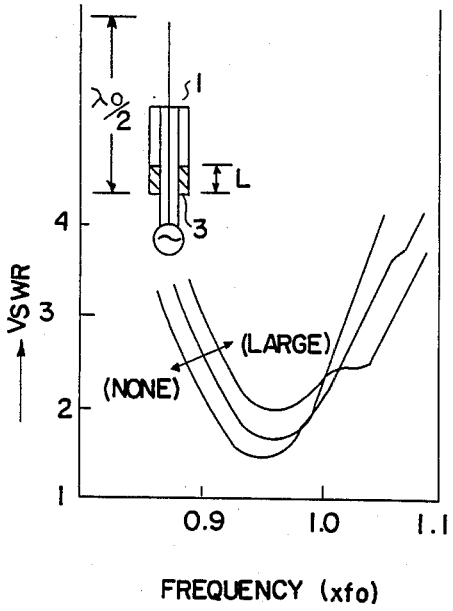
FIG. 3
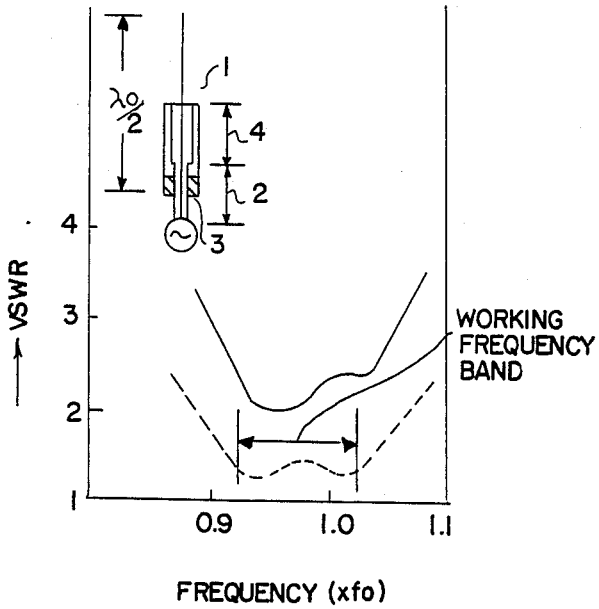

SMALL SIZE ANTENNA FOR BROAD-BAND ULTRA HIGH FREQUENCY

This is a continuation of application Ser. No. 774,759, filed Sept. 11, 1985, abandoned.

BACKGROUND OF THE INVENTION

1. Field of the Invention

The present invention relates to a small size broad-band ultra high frequency antenna used as a car telephone antenna, etc., and more particularly to improvements in the voltage standing wave ratio (hereinafter referred to as VSWR) of such antennas.

2. Prior Art

In general, the major characteristics which affect the performance of small size antennas are gain (directional characteristics) and VSWR. Of the foregoing factors, gain is almost invariably determined by the dimension of the antenna element. However, the VSWR characteristics vary largely depending on the engineering design of the internal structure.

Conventional small size antennas for ultra high frequency (UHF) have generally be relatively unsatisfactory in VSWR characteristics. Particularly, small size ultra high frequency antennas have serious disadvantages since their frequency bands are narrow.

There are several methods of expanding the frequency band. One of the methods is to increase the diameter of the antenna element and lower the "Q" of the antenna characteristics. This method can broaden the VSWR characteristics. Another method is to broaden the frequency band width by inserting two or more stages of matching transformers composed of distributed constant type $\frac{1}{4}$ wave length impedance transducers, between the antenna and feeder line. With this method, the characteristic impedances of the respective stages can be set to become Wagner type characteristics or Chebyshev type characteristics.

FIG. 1 shows the VSWR characteristics of a skirt form dipole antenna as an example. In the FIGURE, a diagram for facillitating understanding of the structure of the antenna is also shown. As seen in FIG. 1, when an antenna element 1 is widened in its diameter as indicated by the broken line, by employing the above mentioned first method, the VSWR characteristics are changed from those represented by the solid line to that shown by the broken line. As a result, the VSWR characteristics broaden, and the frequency band is expanded.

Further, although it is not shown in the FIGURE, when using the second method, two stages of impedance transducers (matching transformers) are interposed between the antenna element 1 and a coaxial feeder line 2 for setting the respective characteristic impedances to becomes:

$$Z_{m1}=Z_{o4}^{\frac{3}{4}}\cdot Z_{a}^{\frac{1}{4}},\ Z_{m2}=Z_{o4}^{\frac{1}{4}}\cdot Z_{a}^{\frac{3}{4}}$$

the VSWR becomes "1" in center frequency, thus obtaining Wagner's characteristics. In this manner, the closer the apparent antenna impedance is brought to the characteristic impedance ZO of the feeder line, the more the VSWR is improved by getting closer to "1".

However, the antennas in conventional use which have had the foregoing improved methods applied to them have the following problems. Particularly, in the antennas using the first method, the diameter of the antenna element is increased. Accordingly, such an antenna element cannot be used as a portable antenna, an enclosed antenna, etc., since these types of antennas need to be small in diameter in view of their function. Consequently, the first method makes it not feasible to construct, for example, a broad-band portable antenna and a broad-band enclosed antenna. Because of the plural number of stages of matching transformers used in the second method, antennas which use this method not only have a complicated structure but also the total length of the antenna is increased. Thus, the second method makes it impossible to construct a broad-band antenna which is short in length.

SUMMARY OF THE INVENTION

Taking into account the foregoing problems in the conventional antennas of this type, the primary object of the present invention is to provide an antenna which is markedly broad in applicable frequency band width and is highly efficient in performance, thereby making it possible to be used as a car telephone antenna and MCA.

Another object of the present invention is to provide a small size antenna for broad-band ultra high frequency, that is small in size and lightweight so that it can be used as a portable, mounted-on-vehicle type and/or an enclosed type antenna.

The above mentioned objects of the present invention are achieved via a unique structure for antennas wherein in order to broaden the frequency band without increasing the diameter of the antenna element, the resonance frequency of the body of a sleeve-form ultra high frequency antenna and the resonance frequency of the sleeve portion of the foregoing antenna are brought closer to each other for effecting double tuning. Thus, double-peak characteristics are obtained for the antenna characteristics. As a method of controlling the resonance frequency of the sleeve portion, according to this invention, a specified amount of dielectric substance is inserted into the sleeve to change the equivalent electric length of the sleeve portion.

In another embodiment of this invention, a matching transformer is employed in order to implement the mating of the impedance of the antenna having the aforementioned double-peak characteristics to the characteristic impedance of the feeder line that is connected to the foregoing antenna, within the working frequency band. The matching transformer is a single stage coaxial type impedance transducer and is set to have the length to include the opposite reactance component (element) serving to offset the reactance component of the antenna. The above mentioned impedance transducer also has the characteristic impedance capable of being converted into the feeder line impedance.

BRIEF DESCRIPTION OF THE DRAWINGS

FIG. 1 is a characteristics chart showing the VSWR characteristics of a conventional ultra high frequency antenna;

FIGS. 2 and 3 are VSWR characteristics charts for explaining the principles of the present invention.

DETAILED DESCRIPTION OF THE INVENTION

Figure 4:
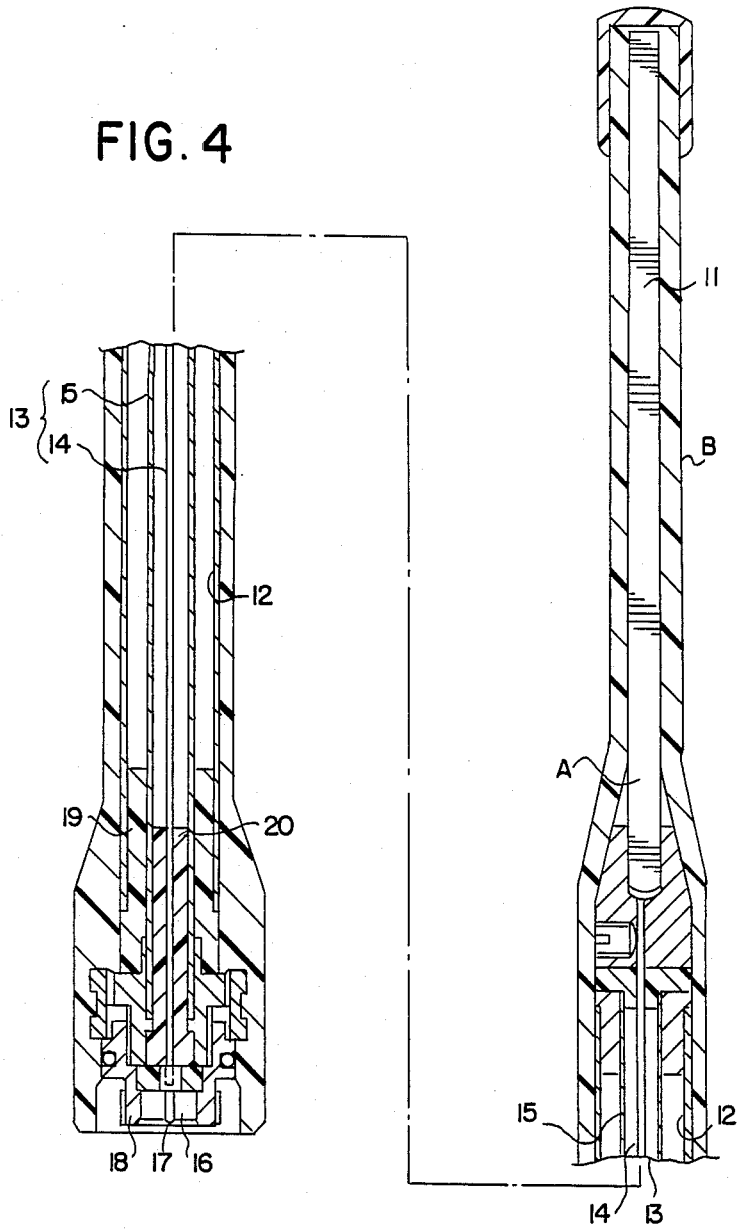
FIG. 4 shows longitudinal sectional views of a small size antenna for broad-band ultra high frequency used for handy type wireless telephones as an embodiment of the present invention.

FIGS. 2 and 3 are charts of VSWR characteristics explaining the principles of the present invention. As in FIG. 1, in FIGS. 2 and 3 diagramatic sketches of a skirt-form dipole antenna are inset, respectively, for facillitating understanding of the structure.

When a dielectric substance 3 is inserted into the sleeve and the equivalent electric length of the sleeve portion is varied, the VSWR characteristics with respect to the amount insert, which are observed from the feeding point, are varied as shown by the curves in FIG. 2. Therefore, by determining the amount L of the dielectric substance 3 to be inserted for obtaining the necessary band width, the antenna characteristics wherein the VSWR shows the double-peak characteristics as indicated by the solid line in FIG. 3 can be obtained. As a result, broadening of the frequency band can be achieved without increasing the diameter of the antenna element 1.

Also, FIG. 3 shows a chart of VSWR characteristics wherein a coaxial type impedance transducer 4 is inserted. This coaxial impedance transducer 4 has the length and characteristic impedance capable of contradicting (offsetting) the reactance component in the impedance characteristics of the antenna which shows the previously mentioned double-peak characteristics. Furthermore, the foregoing coaxial impedance transducer 4 is capable of matching its characteristic impedance to the impedance of the feeder line. When the above mentioned coaxial impedance transducer 4 is inserted in the antenna, as shown by the broken line in FIG. 3, the VSWR in the working frequency band shows the most desirable value, and also the characteristics are leveled.

FIG. 4 is a longitudinal sectional view of an embodiment of a small size broad-band ultra high frequency antenna of the present invention which can be used with a handy-type wireless telephone. When this small size ultra high frequency antenna is used for a car telephone, it is a minature antenna about 200 mm in total length with a little over ½ of working wave length. As the antenna body A, a non-grounded type dipole antenna element for ultra high frequency is used. The top area of the foregoing dipole antenna element is made flexible for safety purposes. The antenna body A is covered with a flexible insulating antenna cover B which is screwed onto the antenna body A so as to combine the antenna cover B with the antenna body A to form a single unit. The above mentioned antenna cover B is made of flexible insulating material which is relatively low in dielectric constant value, for example, a polyethylene system material.

The antenna body A includes an upper element 11 and a lower element 12. The upper element 11, formed of a plural number of layers of helically coiled small-diameter conducting wire, is flexible. The lower element 12 is formed of metal pipe. Inside the lower element 12, matching transformer 13 constructed of coaxial impedance transducer is housed. The matching transformer 13 is formed of a central conductor 14 and another conductor 15. The top end of the central conductor 14 is connected to the above mentioned upper element 11, and the top end of the outer conductor 15 is connected to the lower element 12. Also, the root of the central conductor 14 is connected to a transceiver set connecting pin 17 of a connector 16. The root of the outer conductor 15 is connected to a ring-form conductor 18 of the connector 16.

The lower element 12 and the outer conductor 15 of the matching transformer 13 form a coaxial type resonator of point short-circuit. In the sleeve adjacent to the open end at the root of this resonator, where the voltage distribution is highest in degree, a dielectric substance 19 made of, for example, teflon, is inserted in a specified amount. By means of this dielectric substance 19, the equivalent electric length at the foregoing sleeve portion is varied, and its resonance frequency is made to suitable to the resonance frequency of the antenna body A. In this manner, a double tuning circuit is formed, and the double-peak characteristics are obtained.

Also, the foregoing central conductor 14 and the outer conductor 15 form a coaxial, distributed-constant-system impedance transducer of Sm in characteristic impedance and Lm in electric length. The above mentioned electric length Lm must be specified for its length mechanically, but the characteristic impedance Zm can be relatively optionally selected by placing the dielectric substance 20 over the central conductor 14, by selecting the thickness of the dielectric substance 20 from various thicknesses. In this manner, when the most appropriate values are set for the foregoing Lm and Sm, the reactance component of the antenna in the working frequency band can be offset (anihilated) and the impedance value can be converted, in order to achieve the matching to the feeder line including the connector 16.

As has been mentioned above, according to the the present invention, a small size high performance antenna for broad-band ultra high frequency can be obtained. Furthermore, the respective portions of the antenna are designed to perform dual and common functions. Therefore, the structure of the antenna becomes simple, and it becomes easy to manufacture the antenna. Also, antennas with uniform performance can be manufactured. In addition, a small size, light weight, and high performance antenna that is quite suitable as a portable antenna can be provided.

The present invention is not limited to that demonstrated by the above mentioned embodiment. For example, in the foregoing embodiment, as the upper element, a flexible, spiral form conductor is used. However, a metal wire or a metal pipe may be used instead of the flexible, spiral form conductor, for the upper element. It will also be obvious that changes within the scope of the claims may be made without departing from the features and spirit of the present invention in its broader aspects.

The characteristic achievements brought about by the present invention will be recapitulated as follows:

In the first invention, in order to broaden the frequency band without necessitating an increase in the diameter of the antenna element, a specified amount of dielectric substance is inserted into the sleeve of the body of a broad-band ultra high frequency antenna. Thus, the resonance frequency of the sleeve portion is approximated to the resonance frequency of the antenna body in order to effect double tuning, obtaining the double-peak characteristics for the antenna characteristics. As a result, broadening of the frequency band can be accomplished without increasing the diameter of the antenna element.

In the second embodiment, a matching transformer is employed for effecting matching between the impedance of the antenna having the afore mentioned double-peak characteristics and the characteristic impedance of the feeder line connected to the foregoing antenna within the working frequency band. This matching transformer is composed of, for example, a single stage coaxial type impedance transducer which is set to have the length to include the opposite reactance component sufficient to offset and anihilate the reactance component of the antenna. The transducer has the characteristic impedance convertible to feeder line impedance. In this manner, the VSWR in the working frequency band shows the optimum value, and leveling of the characteristics can be realized.

As should be apparent from the description given above, the present invention provides a small size, light weight broad-band antenna to be used for ultra high frequency which is markedly broad in applicable frequency band width and high in performance efficiency. Such a small size, light weight, broad-band ultra high frequency antenna is ideal for car telephones and MCA, and it is also applicable for use as a portable type mounted-on-vehicle type, and/or enclosed type antenna.

We claim:

1. A small size broad-band ultra high frequency antenna for a predetermined working frequency band comprising:

an upper antenna element;

a center conductor element provided subjacent said upper antenna element and along a same axis of said upper antenna element, said center conductor element further being electrically coupled to said upper antenna element at one end and providing a feed for said antenna at another end thereof;

an outer conductor element provided coaxially with said center conductor;

a lower antenna element provided coaxially with the outer conductor element;

a coaxial matching device comprised of said center conductor and said outer conductor element, a length of said coaxial matching device being selected to provide an opposite reactance component sufficient to deny a reactance component of said antenna in said working frequency band;

a first dielectric material provided between said center and outer conductor elements wherein said first dielectric material and said outer conductor element set the length of a matching impedance transformer for said antenna to a predetermined length; and a second dielectric material provided between said outer conductor element and said lower antenna element, said second dielecric material, said outer conductor element and said lower antenna element forming a coaxial resonator, said second dielectric material further being of a predetermined length such that a resonant frequency of said coaxial resonator is substantially the same as a resonant frequency of said antenna whereby double peaked impedance characteristics within said working frequency band of said antenna and therefore a broadened working frequency band are provided for said antenna.

2. A small size broad-band ultra high frequency antenna of a broad working frequency band, low Q and low reactance at a working frequency band, comprising:

an upper antenna element having a top end and a bottom end;

a center conductor element provided subjacent said upper antenna element and along a same axis of said upper antenna element with the top end of said center conductor element being coupled to said bottom end of said upper antenna element and providing a feed for said antenna at said bottom end of said center conductor element;

an outer conductor element provided coaxially with said center conductor and electrically insulated from said center conductor, said outer conductor having a top end and a bottom end with said bottom end of said outer conductor providing a feed for said antenna;

a coaxial matching device which is comprised of said center conductor element and outer conductor element of a length to provide an opposite reactance component sufficient to deny a reactance component of said antenna in said working frequency band;

a lower antenna element provided coaxially with and surrounding said outer conductor element and having a top end and a bottom end with said top end being electrically coupled to said top end of said outer conductor and wherein, a length of said lower antenna element being selected to resonate in said working frequency band;

a first dielectric material provided between said center and outer conductor elements wherein said first dielectric material and said outer conductor element set length of a matching impedance transformer for said antenna to a predetermined length; and a second dielectric material provided between said outer conductor element and said lower antenna element, said second dielectric material, said outer conductor element and said lower antenna element forming a coaxial resonator, said second dielectric material further being of a predetermined length such that a resonant frequency of said coaxial resonator is substantially the same as a resonant frequency of said antenna whereby double peaked impedance characteristics within said working frequency band of said antenna are provided for said antenna.

* * * * *